US011752658B2

(12) United States Patent
Dutterer

(10) Patent No.: US 11,752,658 B2
(45) **Date of Patent: *Sep. 12, 2023**

(54) TABLE SAW

(71) Applicant: TECHTRONIC CORDLESS GP, Anderson, SC (US)

(72) Inventor: David E. Dutterer, Belton, SC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/838,663

(22) Filed: Jun. 13, 2022

(65) Prior Publication Data

US 2022/0297341 A1 Sep. 22, 2022

Related U.S. Application Data

(63) Continuation of application No. 16/898,663, filed on Jun. 11, 2020, now Pat. No. 11,383,401.

(60) Provisional application No. 62/861,137, filed on Jun. 13, 2019.

(51) Int. Cl.

| | |
|---|---|
| ***B27G 19/08*** | (2006.01) |
| ***B27G 19/04*** | (2006.01) |
| ***B26D 7/22*** | (2006.01) |

(52) U.S. Cl.

CPC ..... *B27G 19/08* (2013.01); *B26D 7/22* (2013.01); *B27G 19/04* (2013.01)

(58) Field of Classification Search

CPC ..... B27G 19/08; B27G 19/04; B26D 7/22; B23D 47/025; B23D 45/06; B23D 45/061; B23D 45/062; B23D 45/063; B23D 45/065; B23D 45/066; B23D 45/067; B23D 45/068; Y10T 83/7734; Y10T 83/7726; Y10T 83/773; Y10T 83/8773; Y10T 83/9372; B27B 5/181; B27B 5/182; B27B 5/184; B27B 5/185; B27B 5/187; B27B 5/188; B27B 5/202

See application file for complete search history.

(56) References Cited

U.S. PATENT DOCUMENTS

| | | | | | |
|---|---|---|---|---|---|
| 2,020,222 | A | * | 11/1935 | Tautz | B23D 47/025 269/309 |
| 3,289,713 | A | * | 12/1966 | Herzog | B23D 47/025 292/228 |
| 5,159,864 | A | * | 11/1992 | Wedemeyer | B23D 47/025 83/477.1 |

(Continued)

*Primary Examiner* — Jonathan G Riley

(74) *Attorney, Agent, or Firm* — Michael Best & Friedrich LLP

(57) ABSTRACT

A table saw including a table having a top surface, an opening in the table through which a saw blade extends, and a throat plate receivable within the opening. The throat plate includes a front end that sits flush with the top surface of the table, a back end that sits flush with the top surface of the table, a top surface that is co-planar with the top surface of the table, and a wear plate pocket that is recessed from the top surface of the throat plate. The wear plate pocket defines a bottom surface that is oriented at an oblique angle relative to the top surface of the throat plate and slopes downward in a direction from the back end toward the front end. The wear plate positioned within the wear plate pocket. The wear plate sitting parallel to the bottom surface of the wear plate pocket.

20 Claims, 4 Drawing Sheets

(56) References Cited

U.S. PATENT DOCUMENTS 5,398,740 A * 3/1995 Miller ..... B23Q 1/0054 144/286.5
5,970,835 A * 10/1999 Kenyon ..... B27C 5/02 144/286.5
6,076,445 A * 6/2000 Kenyon ..... B27C 9/02 144/286.5
6,422,116 B1 * 7/2002 Kenyon ..... B23D 47/025 144/286.5
7,134,373 B1 * 11/2006 Vice ..... B23D 47/025 83/477.1
9,919,369 B2 * 3/2018 Gass ..... B23D 47/025
11,383,401 B2 * 7/2022 Dutterer ..... B26D 7/22
2001/0013268 A1 * 8/2001 Dils ..... B23D 45/062 83/522.18
2004/0159200 A1 * 8/2004 Stoffel ..... B23D 47/025 83/581
2005/0160895 A1 * 7/2005 Garcia ..... B27G 19/08 83/581
2005/0188806 A1 * 9/2005 Garcia ..... B23D 45/10 83/477.1
2006/0144470 A1 * 7/2006 Fontaine ..... B27C 9/04 144/287
2006/0219076 A1 * 10/2006 Gass ..... B23D 47/025 83/477.1
2007/0095185 A1 * 5/2007 Chang ..... B27G 19/02 83/478
2007/0186739 A1 * 8/2007 Peot ..... B27G 19/08 83/477.2
2008/0156162 A1 * 7/2008 Chuang ..... B23D 47/025 83/478
2009/0261217 A1 * 10/2009 Clark ..... B23Q 1/25 248/188.4
2011/0203438 A1 * 8/2011 Nenadic ..... B23D 45/06 83/477.2
2015/0107430 A1 * 4/2015 Gass ..... B23D 47/025 83/477.2
2015/0151371 A1 * 6/2015 Gass ..... B23D 47/025 83/859
2016/0263680 A1 * 9/2016 Doumani ..... B23D 45/067
2017/0072481 A1 * 3/2017 Gass ..... B27G 19/00
2018/0339422 A1 * 11/2018 Fulmer ..... B27G 19/00
2018/0345526 A1 * 12/2018 Garces ..... B27G 19/02
2020/0391403 A1 * 12/2020 Dutterer ..... B27G 19/08

* cited by examiner

TABLE SAW

CROSS-REFERENCE TO RELATED APPLICATIONS

This application claims priority to co-pending U.S. patent application Ser. No. 16/898,663 filed on Jun. 11, 2020, which claims priority to U.S. Provisional Patent Application No. 62/861,137 filed on Jun. 13, 2019, the entire contents of both of which are incorporated by reference herein.

FIELD OF THE DISCLOSURE

The present disclosure relates generally to power tools, and in particular to improvements for power table saws.

SUMMARY OF THE DISCLOSURE

In one aspect, the invention provides a table saw including a table having a top surface, an opening in the table through which a saw blade extends, and a throat plate receivable within the opening. The throat plate includes a front end that sits flush with the top surface of the table, a back end that sits flush with the top surface of the table, a top surface that is co-planar with the top surface of the table, and a wear plate pocket that is recessed from the top surface of the throat plate. The wear plate pocket defines a bottom surface that is oriented at an oblique angle relative to the top surface of the throat plate and slopes downward in a direction from the back end toward the front end. The wear plate positioned within the wear plate pocket. The wear plate sitting parallel to the bottom surface of the wear plate pocket.

In another aspect, the invention provides a throat plate for a table saw. The table saw includes a table having an opening through which a saw blade extends. The throat plate includes a front end, an opposite back end, a top surface that is co-planar with a top surface of the table, such that the top surface of the throat plate is configured to support and contact a workpiece between the front end and the back end, and a wear plate pocket that is recessed from the top surface of the throat plate. The wear plate pocket defines a bottom surface oriented at an oblique angle relative to the top surface of the throat plate and slopes downward in a direction from the back end toward the front end. The table saw further includes a wear plate positioned within the wear plate pocket, the wear plate sitting parallel to the bottom surface of the wear plate pocket with at least a portion sitting sub-flush from the top surface of the throat plate.

Other independent aspects of the invention will become apparent by consideration of the detailed description, claims and accompanying drawings.

Before any embodiments of the disclosure are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
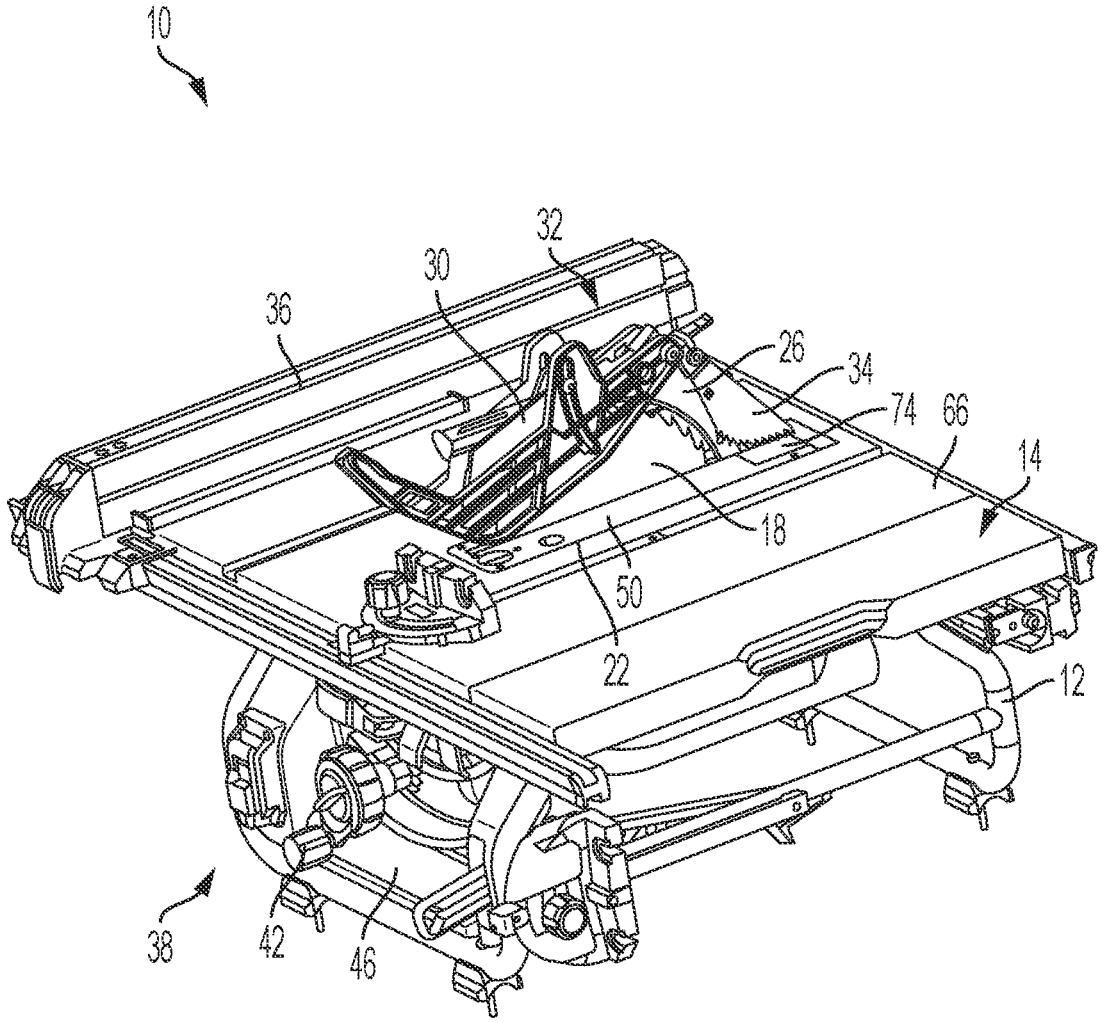
FIG. 1 is a front perspective view of a table saw in accordance with an embodiment of the present disclosure.

With reference to FIG. 1, a table saw 10 includes a tubular base 12, a table 14 atop the base 12 upon which a workpiece is supported, and a saw blade 18 protruding through an opening 22 in the table 14. The table saw 10 may include a riving knife 26 positioned behind the saw blade 18 and a blade guard assembly 30 supported by the riving knife 26 for covering the top and opposite sides of the saw blade 18. The riving knife 26 may also support an anti-kickback pawl assembly 32, which prevents "kickback" of the workpiece toward the operator of the table saw 10. Specifically, the assembly 32 includes two serrated pawls 34 (although only one of which is shown) that are biased toward the table 14 and slide along the workpiece during a cutting operation to inhibit the workpiece from inadvertently moving upward relative to the table 14. Also, a guide rail 36 is removably coupled to the table 14 for guiding a workpiece through the saw blade 18 during the cutting operation.

With continued reference to FIG. 1, the table saw 10 may additionally include a blade height adjustment mechanism 38 that is operable to raise and lower the saw blade 18 relative to the table 14. The blade height adjustment mechanism 38 may include a crank 42 that is disposed in front of a front panel 46 of the base 12. The crank 42 is rotatable, for example, in a clockwise direction to raise the saw blade 18. In contrast, the crank 42 is rotatable, for example, in a counter-clockwise direction to lower the saw blade 18. Other types of blade height adjustment mechanisms are contemplated.

Figure 2:
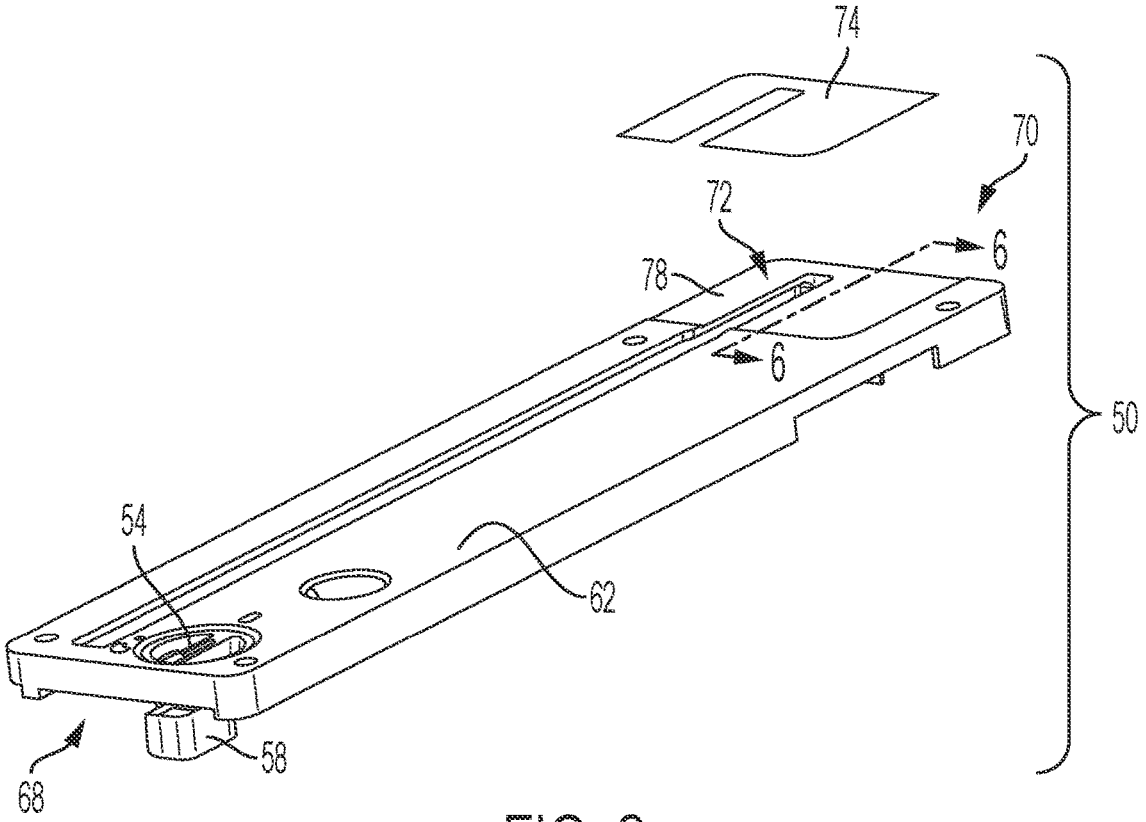
FIG. 2 is a front perspective view of a throat plate of the table saw of FIG. 1, illustrating a wear plate exploded from the throat plate.

The table saw 10 also includes a motor (not shown) for rotationally driving the saw blade 18 during the cutting operation. The motor, as well as other components disposed underneath the table 14, are accessible for maintenance through a side of the tubular base 12 or through the opening 22 in the table 14 after a throat plate 50 is removed from the table 14. Typically, the throat plate 50 is seated within the opening 22 during the cutting operation. As shown in FIG. 2, the throat plate 50 may be removable from the table 14 by rotating a knob 54, which correspondingly rotates a locking arm 58 that selectively interferes with an underneath portion of the table 14 (e.g., in a locking position of the locking arm 58). When the locking arm 58 no longer mechanically interferes with the underneath portion of the table 14 (e.g., in a released position of the locking arm 58), the throat plate 50 is capable of being removed from the table 14.

Figure 3:
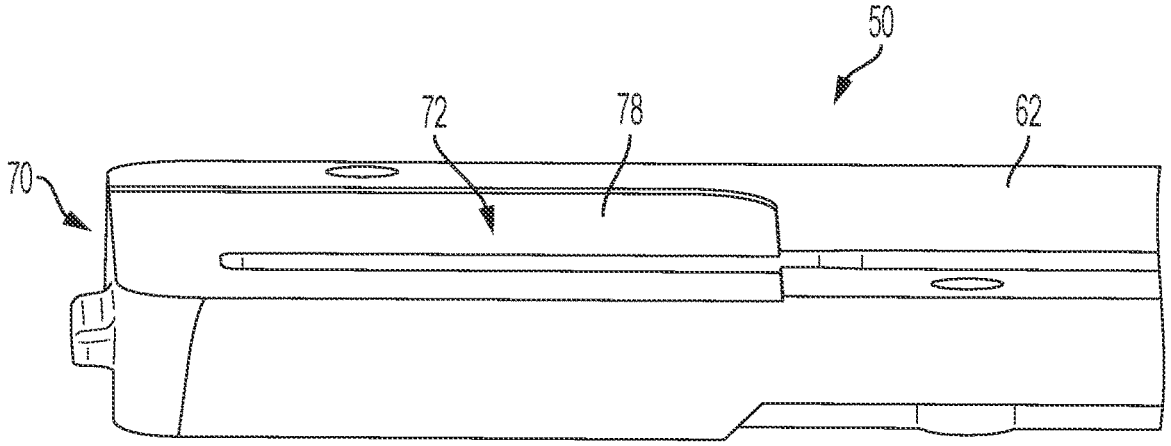
FIG. 3 is a side perspective view of the throat plate of FIG. 2, illustrating a wear plate pocket capable of accommodating the wear plate.

With reference to FIGS. 2 and 3, the throat plate 50 may additionally include a top surface 62 that is co-planar with a top surface 66 of the table 14 when the throat plate 50 is seated within the opening 22. The throat plate 50 also includes a front end 68, a back end 70, and a wear plate pocket 72 that is recessed from the top surface 62 of the throat plate 50 and disposed adjacent the back end 70 of the throat plate 50. A wear plate 74 is received within the wear plate pocket 72, such that no portion of the wear plate 74 extends above the top surface 62 of the throat plate 50. In some embodiments, portions of the wear plate 74 may be flush, or approximately flush, with the top surface 62 of the throat plate 50. The wear plate 74 may be composed of a metallic material and coupled to the throat plate 50 in a location generally beneath the vertically projected area of the anti-kickback pawl assembly 32. As a result of the pawls 34 being biased toward the table 14, the serrated pawls 34 rest upon the wear plate 74 when there is no workpiece being fed through the blade 18. The wear plate 74 inhibits the top surface 62 of the throat plate 50 from being marred by the serrated pawls 34.

Figure 4:
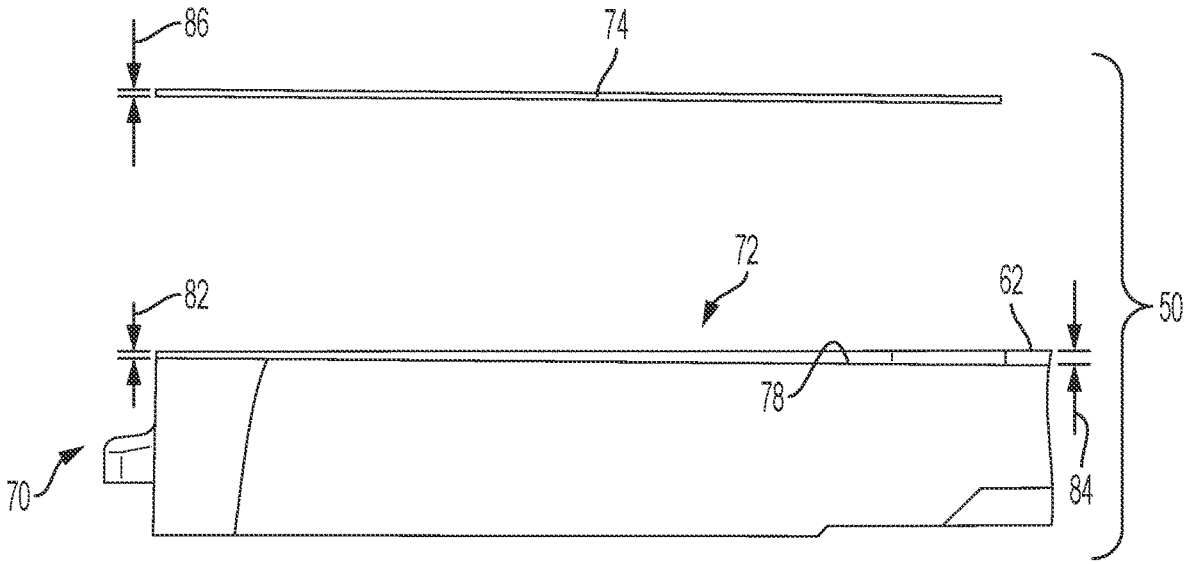
FIG. 4 is a side plan view of the throat plate of FIG. 2, illustrating the wear plate exploded from the wear plate pocket.
Figure 5B:
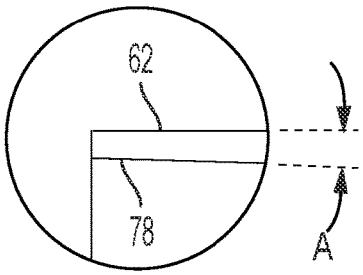
FIG. 5B is an enlarged view of the throat plate of FIG. 5A.
Figure 5A:
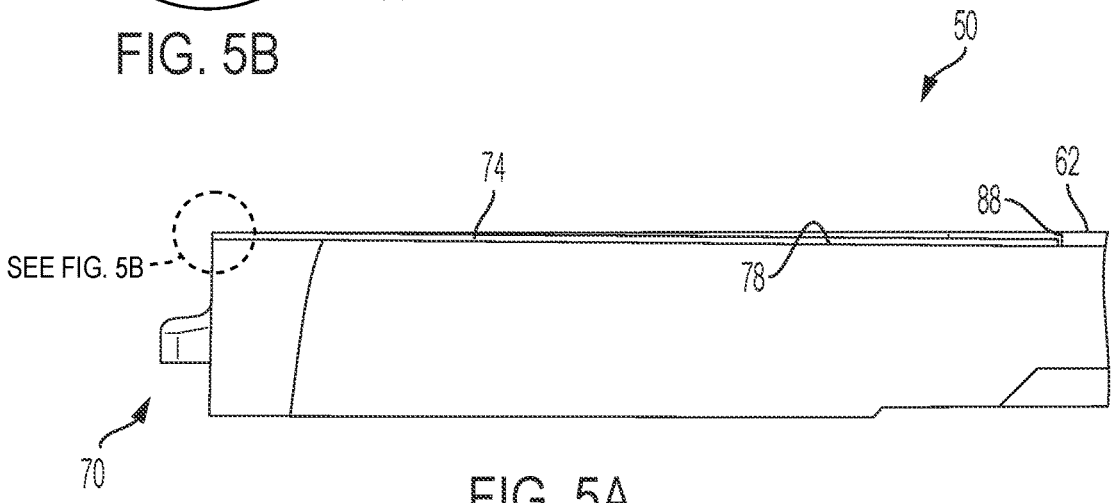
FIG. 5A is a side plan view of the throat plate of FIG. 2, illustrating the wear plate seated within the wear plate pocket.
Figure 6:
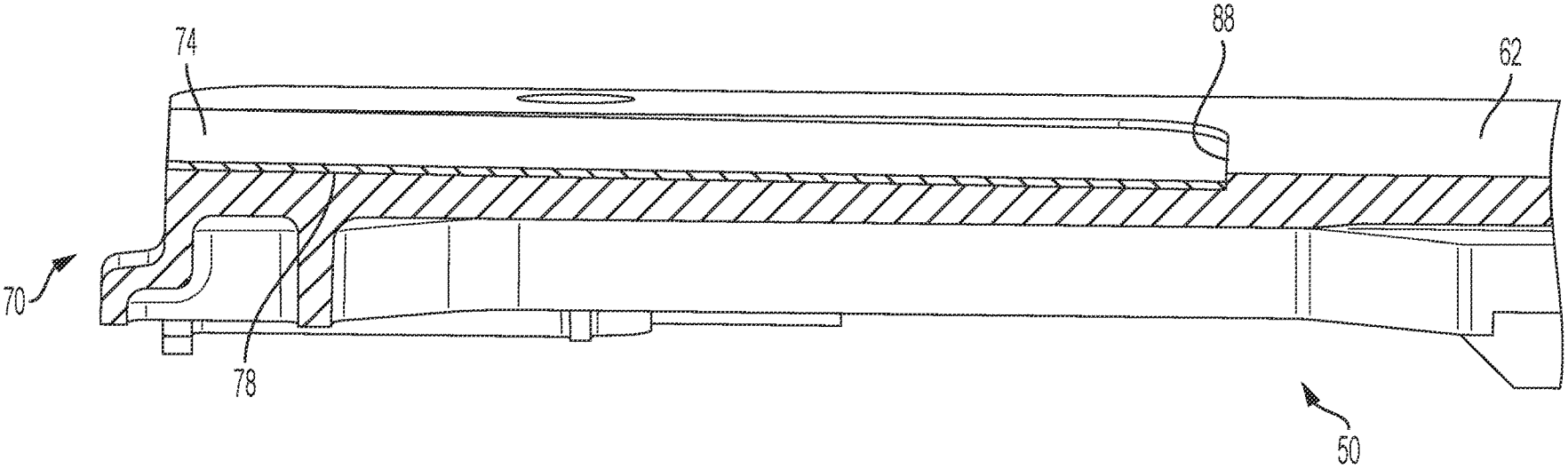
FIG. 6 is a cross-sectional view of the throat plate along line 6-6 of FIG. 2, illustrating the wear plate seated within the wear plate pocket.

With reference to FIGS. 4-5B, the wear plate pocket 72 includes a bottom surface 78 that is not parallel to the top surface 62 of the throat plate 50. Instead, the bottom surface 78 is acutely angled (or inclined) relative to the top surface 62 of the throat plate 50 by an angle A (FIG. 5B). Specifically, the bottom surface 78 is angled equal to or less than 1.0 degrees relative to the top surface 62 of the throat plate 50. More specifically, the bottom surface 78 is angled between approximately 0.2 degrees and approximately 1.0 degrees relative to the top surface 62 of the throat plate 50. Even more specifically, the bottom surface 78 is angled by an angle A of 0.3 degrees (±0.7 degrees) relative to the top surface 62 of the throat plate 50, with the bottom surface 78 sloping downward in a direction from the back end 70 toward the front end 68 (FIG. 5A). Stated another way, the wear plate pocket 72 has a first depth 82 adjacent the back end 70 of the throat plate 50 and a second depth 84 on an opposite end of the pocket 72, where the second depth 84 is greater than the first depth 82. The first and second depths 82, 84 are measured from the top surface 62 of the throat plate 50 to the bottom surface 78 of the wear plate pocket 72. The difference between the first depth 82 and the second depth 84 is approximately 0.01 inch to 0.02 inch. More specifically, the difference between the first depth 82 and the second depth 84 is approximately 0.012 inch, creating a slope (or incline) of 0.012 inch over a length of the wear plate pocket 72, which is approximately 2.25 inches to 2.3 inches.

The wear plate 74, in contrast, defines a constant thickness 86 that is approximately equal to the first depth 82. Therefore, the wear plate 74 may be approximately flush with the top surface 62 of the throat plate 50 adjacent the back end 70, whereas the opposite end of the wear plate 74 may be sub-flush with the top surface 62 of the throat plate 50 (FIG. 5A). The pocket 72, therefore, defines a vertical lip 88 adjacent the top surface 62 due to the wear plate 74 being sub-flush (or sunken) from the top surface 62 of the throat plate 50 to avoid wood chips from lodging underneath and lifting the wear plate 74.

Various features of the invention are set forth in the following claims.

What is claimed is:

1. A table saw comprising:

a table having a top surface;

an opening in the table through which a saw blade extends;

a throat plate receivable within the opening, the throat plate including a front end that sits flush with the top surface of the table, a back end that sits flush with the top surface of the table, the back end is opposite the front end, a top surface that is co-planar with the top surface of the table, and a wear plate pocket that is recessed from the top surface of the throat plate, wherein the wear plate pocket defines a bottom surface that is oriented at an oblique angle relative to the top surface of the throat plate and slopes downward in a direction from the back end toward the front end; and a wear plate positioned within the wear plate pocket, the wear plate sitting parallel to the bottom surface of the wear plate pocket.

2. The table saw of claim 1, further comprising:

a riving knife positioned behind the saw blade and extending upward from underneath the table; and an anti-kickback pawl supported by the riving knife and positioned above both the throat plate and the wear plate.

3. The table saw of claim 1, wherein the wear plate is made from a metal.

4. The table saw of claim 2, wherein the wear plate is coupled to the throat plate in facing relationship with the anti-kickback pawl, and wherein the anti-kickback pawl is biased into contact with the wear plate.

5. The table saw of claim 1, wherein the wear plate is disposed proximate the back end of the throat plate.

6. The table saw of claim 1, wherein the throat plate further includes a knob that is disposed proximate the front end to which a locking arm is coupled for co-rotation therewith, and wherein the knob is rotatable by a user to move the locking arm between a locking position in which the throat plate is secured to the table, and a release position in which the throat plate is removable from the table.

7. The table saw of claim 6, wherein the knob is accessible from the top surface of the throat plate and the locking arm is positioned beneath the throat plate.

8. The table saw of claim 1, wherein at least a portion of a top surface of the wear plate is sub-flush with the top surface of the throat plate, and wherein no portion of the wear plate extends above the top surface of the throat plate.

9. The table saw of claim 8, further comprising a lip that is formed between the top surface of the wear plate and the top surface of the throat plate due to the wear plate being sub-flush from the top surface of the throat plate.

10. The table saw of claim 1, wherein the bottom surface of the wear plate pocket is oriented at an oblique angle relative to the top surface of the throat plate between 0.2 degrees and 1.0 degree.

11. The table saw of claim 1, wherein the bottom surface of the wear plate pocket is oriented at an oblique angle relative to the top surface of the throat plate of 0.3 degrees.

12. The table saw of claim 1, wherein the wear plate pocket has a first depth adjacent the back end of the throat plate and a second depth spaced away from the back end toward the front end of the throat plate, wherein the first depth and the second depth are measured from the top surface of the throat plate to the bottom surface of the wear plate pocket, wherein the second depth is greater than the first depth.

13. The table saw of claim 12, wherein the difference between the first depth and the second depth is 0.01 inch to 0.02 inch.

14. The table saw of claim 12, wherein the difference between the first depth and the second depth is 0.012 inch.

15. The table saw of claim 12, wherein the wear plate has a constant thickness that is equal to the first depth, such that one end of the wear plate is flush with the top surface of the throat plate adjacent the back end, and wherein an opposite end of the wear plate is sub-flush with the top surface of the throat plate.

16. A throat plate for a table saw, the table saw including a table having an opening through which a saw blade extends, the throat plate comprising:

a front end;

an opposite back end;

a top surface that is co-planar with a top surface of the table, such that the top surface of the throat plate is configured to support and contact a workpiece between the front end and the back end; and a wear plate pocket that is recessed from the top surface of the throat plate, the wear plate pocket defines a bottom surface oriented at an oblique angle relative to the top surface of the throat plate and slopes downward in a direction from the back end toward the front end; and a wear plate positioned within the wear plate pocket, the wear plate sitting parallel to the bottom surface of the wear plate pocket with at least a portion sitting sub-flush from the top surface of the throat plate.

17. The throat plate of claim 16, wherein the wear plate pocket has a first depth adjacent the back end of the throat plate and a second depth spaced away from the back end toward the front end of the throat plate, wherein the first depth and the second depth are measured from the top surface of the throat plate to the bottom surface of the wear plate pocket, wherein the second depth is greater than the first depth.

18. The throat plate of claim 17, wherein the wear plate has constant thickness that is equal to the first depth such that the wear plate sits flush with the top surface adjacent the back end, and wherein the wear plate sits sub-flush with the top surface at the opposite end of the wear plate pocket.

19. The throat plate of claim 17, wherein the difference between the first depth and the second depth is 0.01 inch to 0.02 inch.

20. The throat plate of claim 16, further comprising a lip that is formed between a top surface of the wear plate and the top surface of the throat plate due to the wear plate being sub-flush from the top surface of the throat plate.

* * * * *